US010463938B1

(12) United States Patent
Edwards et al.

(10) Patent No.: US 10,463,938 B1
(45) Date of Patent: Nov. 5, 2019

(54) FOOTBALL TACKLING PRACTICE ASSEMBLY

(71) Applicants: Issac Edwards, Springhill, FL (US); David Harvey, Springhill, FL (US)

(72) Inventors: Issac Edwards, Springhill, FL (US); David Harvey, Springhill, FL (US)

( * ) Notice: Subject to any disclaimer, the term of this patent is extended or adjusted under 35 U.S.C. 154(b) by 0 days.

(21) Appl. No.: 15/974,693

(22) Filed: May 9, 2018

(51) Int. Cl.
*A63B 69/34* (2006.01)

(52) U.S. Cl.
CPC ..... *A63B 69/345* (2013.01)

(58) Field of Classification Search
CPC ..... A63B 69/34; A63B 71/00; A63B 21/06
See application file for complete search history.

(56) References Cited

U.S. PATENT DOCUMENTS 1,204,017 A 11/1916 Hinkey
1,906,693 A 5/1933 Loughlin
1,909,461 A * 5/1933 Costa ..... A63B 69/345 473/443
1,917,208 A 7/1933 Maddock
2,234,364 A * 3/1941 Carberry ..... A63B 69/345 473/443
2,558,081 A * 6/1951 Gardenhour ..... A63B 69/345 473/445
3,281,148 A 10/1966 Cummins
4,688,792 A * 8/1987 Rivkin ..... A63B 69/345 473/443
4,822,053 A * 4/1989 Flaherty ..... A63B 71/00 403/108
6,012,994 A * 1/2000 Beluse ..... A63B 69/0026 473/446
6,261,195 B1 7/2001 Shingleton
D624,981 S 10/2010 Forrest, Sr.
2008/0026918 A1 1/2008 Lemke
2012/0283047 A1* 11/2012 DeTroia ..... A63B 69/201 473/442
2012/0309565 A1* 12/2012 Ponstein ..... A63B 69/201 473/443

* cited by examiner

*Primary Examiner* — Eugene L Kim
*Assistant Examiner* — Christopher Glenn

(57) ABSTRACT

A football tackling practice assembly for learning a safe tackling method includes a pair of tubes, a crossbeam, and a dummy. Each tube comprises a plurality of nested sections so that the tube is selectively extensible. The crossbeam is coupled to a top of each tube and extends between the tubes. Each of a pair of bases is coupled to and extends perpendicularly from a bottom of a respective tube. The bases are configured to support the tubes perpendicularly to a surface. A first fastener is coupled to the crossbeam. A second fastener is coupled a helmet that is coupled to a head of the dummy. The second fastener is complementary to the first fastener and is positioned to reversibly couple to the first fastener to couple the dummy to the crossbeam so that the dummy is configured to be tackled by a user.

15 Claims, 4 Drawing Sheets

FOOTBALL TACKLING PRACTICE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to practice assemblies and more particularly pertains to a new practice assembly for learning a safe tackling method.

BRIEF SUMMARY OF THE INVENTION

An embodiment of the disclosure meets the needs presented above by generally comprising a pair of tubes, a crossbeam, and a dummy. Each tube comprises a plurality of nested sections so that the tube is selectively extensible. The crossbeam is coupled to a top of each tube and extends between the tubes. Each of a pair of bases is coupled to and extends perpendicularly from a bottom of a respective tube. The bases are configured to support the tubes perpendicularly to a surface. A first fastener is coupled to the crossbeam. A second fastener is coupled a helmet that is coupled to a head of the dummy. The second fastener is complementary to the first fastener and is positioned to reversibly couple to the first fastener to couple the dummy to the crossbeam so that the dummy is configured to be tackled by a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
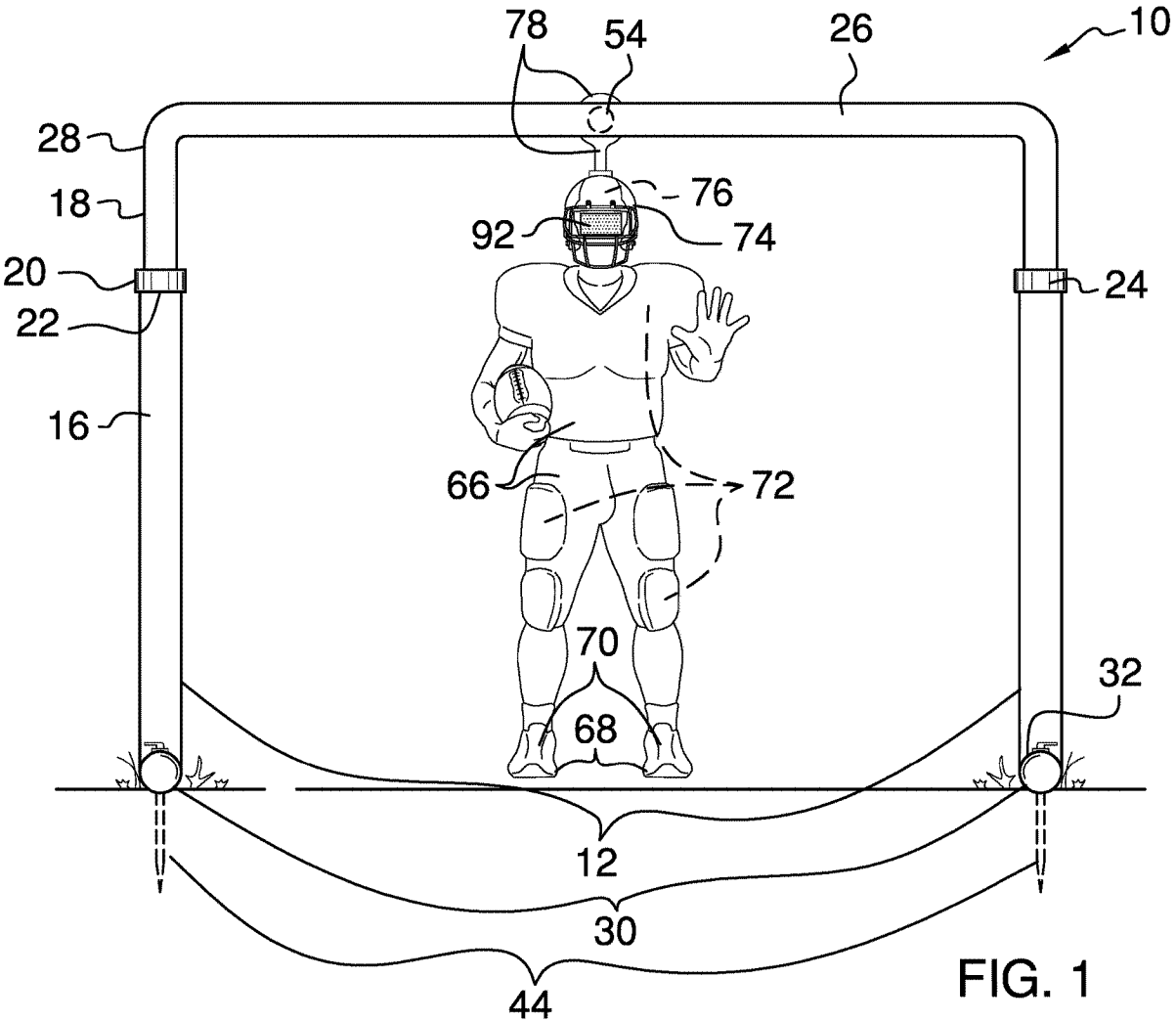
FIG. 1 is a front view of a football tackling practice assembly according to an embodiment of the disclosure.
Figure 2:
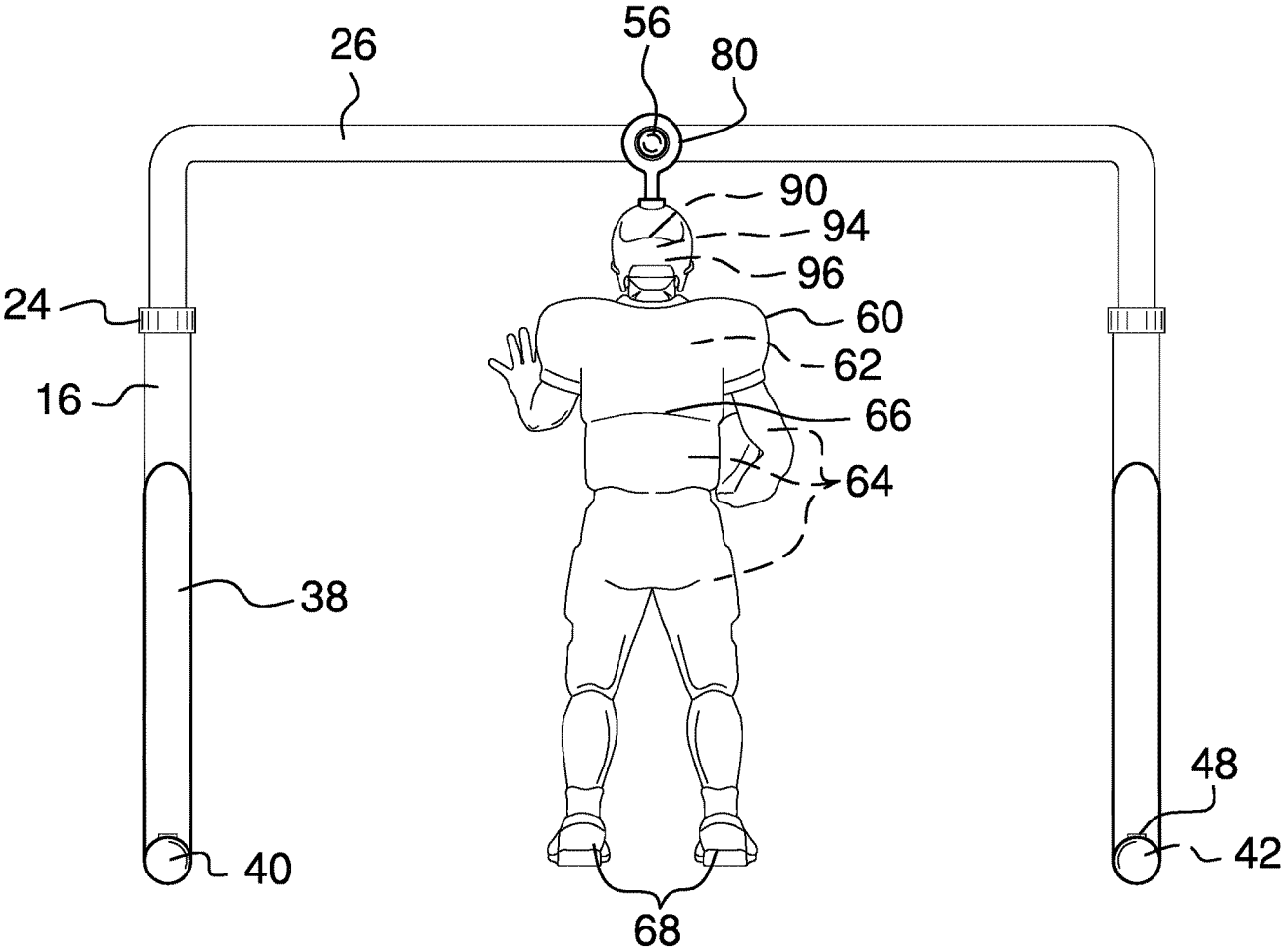
FIG. 2 is a back view of an embodiment of the disclosure.
Figure 3:
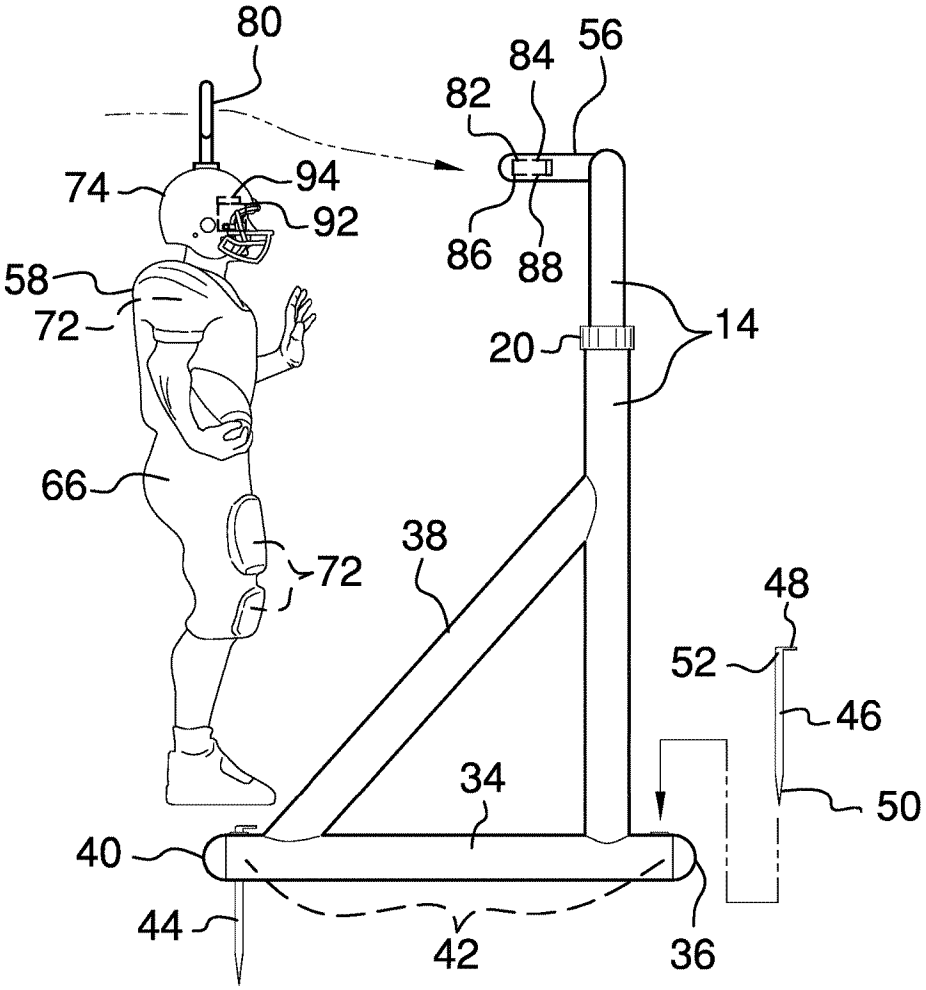
FIG. 3 is a side view of an embodiment of the disclosure.
Figure 4:
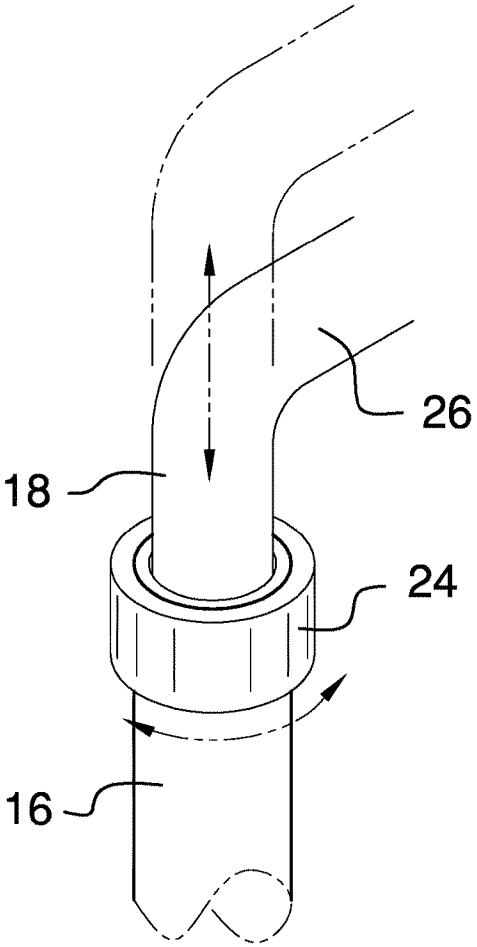
FIG. 4 is a detail view of an embodiment of the disclosure.

With reference now to the drawings, and in particular to FIGS. 1 through 4 thereof, a new practice assembly embodying the principles and concepts of an embodiment of the disclosure and generally designated by the reference numeral 10 will be described.

As best illustrated in FIGS. 1 through 4, the football tackling practice assembly 10 generally a pair of tubes 12. Each tube 12 comprises a plurality of nested sections 14 so that the tube 12 is selectively extensible. The plurality of nested sections 14 comprises a lower section 16 and an upper section 18. The upper section 18 is selectively extensible from the lower section 16. The tubes 12 are circularly shaped when viewed longitudinally. The tubes 12 comprise polyvinyl chloride or the like.

A coupler 20 is coupled to the lower section 16 proximate to an upper end 22 of the lower section 16. The coupler 20 is selectively couplable to the upper section 18 to couple the upper section 18 to the lower section 16 so that the upper section 18 is fixedly positioned relative to the lower section 16. The coupler 20 comprises a compression fitting 24 or the like.

A crossbeam 26 is coupled to a top 28 of each tube 12 and extends between the tubes 12. The crossbeam 26 is circularly shaped when viewed longitudinally. The crossbeam 26 is tubular. The crossbeam 26 comprises polyvinyl chloride or the like.

Each of a pair of bases 30 is coupled to and extends perpendicularly from a bottom 32 of a respective tube 12. The bases 30 are configured to support the tubes 12 perpendicularly to a surface. Each base 30 comprises a first pipe 34 that is coupled to and extends bidirectionally from the respective tube 12. The first pipe 34 extends perpendicularly to a plane defined by the tubes 12 and the crossbeam 26. The respective tube 12 is positioned proximate to a first end 36 of the first pipe 34.

A second pipe 38 is coupled to and extends angularly between the respective tube 12 and the first pipe 34. The second pipe 38 is positioned proximate to a second end 40 of the first pipe 34. The second pipe 38 is configured to brace the respective tube 12. The first pipe 34 and the second pipe 38 are circularly shaped when viewed longitudinally. The first pipe 34 and the second pipe 38 comprise polyvinyl chloride or the like.

Each of a plurality of channels 42 is positioned through a respective first pipe 34. The plurality of channels 42 comprises four channels 42 that are positioned singly proximate to the first end 36 and the second end 40 of each first pipe 34.

Each of a plurality of spikes 44 is configured to insert through a respective channel 42 into the surface to couple the respective first pipe 34 to the surface. Each spike 44 comprises a shaft 46 and a plate 48. The shaft 46 has a first endpoint 50 that is pointed so that the first endpoint 50 is configured to insert into the surface. The plate 48 is coupled to and extends perpendicularly from a second endpoint 52 of the shaft 46. The plate 48 is configured to abut the respective first pipe 34 when the shaft 46 is inserted through the respective channel 42 into the surface.

A first fastener 54 is coupled to the crossbeam 26. The first fastener 54 comprises a rod 56 that is coupled to and extends from the crossbeam 26 equally distant from the tubes 12. The rod 56 extends perpendicularly to the plane defined by the tubes 12 and the crossbeam 26. The rod 56 is tubular. The rod 56 is circularly shaped when viewed longitudinally. The rod 56 comprises polyvinyl chloride or the like.

The assembly 10 comprises a dummy 58 that is humanoid shaped. The dummy 58 comprises a shell 60 that defines an interior space 62. The shell 60 comprises canvas. A filler 64 is positioned in and substantially occupies the interior space 62. The filler 64 comprises foam or the like.

A uniform 66 is positioned on the shell 60. Each of a pair of cleats 68 is positioned on a respective foot 70 of the dummy 58. Protective gear 72 is positioned between the uniform 66 and the shell 60. A helmet 74 is coupled to a head 76 of the dummy 58 so that the dummy 58 is configured to resemble a football player.

A second fastener 78 is coupled to the helmet 74. The second fastener 78 is complementary to the first fastener 54. The second fastener 78 is positioned to reversibly couple to the first fastener 54 to couple the dummy 58 to the crossbeam 26 so that the dummy 58 is configured to be tackled by a user. The second fastener 78 comprises a ring 80. The ring 80 is positioned to insert the rod 56 to couple the dummy 58 to the crossbeam 26. The ring 80 is positioned to slide off the rod 56 to decouple the dummy 58 from the crossbeam 26 upon tackling of the dummy 58 by the user.

A first power module 82, a sensor 84, and a transmitter 86 are coupled to and are positioned in the rod 56. The first power module 82 comprises a first battery 88. The sensor 84 and the transmitter 86 are operationally coupled to the first power module 82. The sensor 84 is configured to detect decoupling of the ring 80 from the rod 56. The transmitter 86 is configured to receive a signal from the sensor 84 upon the user tackling the dummy 58 and to transmit a respective phrase.

A second power module 90, a speaker 92, and a receiver 94 are coupled to the dummy 58. The second power module 90 comprises a second battery 96. The speaker 92 and the receiver 94 are operationally coupled to the second power module 90. The receiver 94 is positioned to receive the respective phrase from the transmitter 86 and to signal the speaker 92 to broadcast the respective phrase to the user. Phrases may include "great hit", "good job", "try again", and the like, to provide encouragement to the user.

In use, the rod 56 is inserted into the ring 80 to couple the dummy 58 to the crossbeam 26. The ring 80 is positioned to slide off the rod 56 to decouple the dummy 58 from the crossbeam 26 upon tackling of the dummy 58 by the user. The sensor 84 is configured to detect decoupling of the ring 80 from the rod 56. The transmitter 86 transmits the respective phrase to receiver 94. The speaker 92 broadcasts the respective phrase to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A football tackling practice assembly comprising:

a pair of tubes, each said tube comprising a plurality of nested sections such that said tube is selectively extensible;

a crossbeam coupled to a top of each said tube and extending between said tubes;

a pair of bases, each said base being coupled to and extending perpendicularly from a bottom of a respective said tube wherein said bases are configured for supporting said tubes perpendicularly to a surface;

a first fastener coupled to said crossbeam, said first fastener comprising a rod coupled to and extending from said crossbeam equally distant from said tubes such that said rod extends perpendicularly to a plane defined by said tubes and said crossbeam, said rod being tubular;

a dummy;

a helmet coupled to a head of said dummy;

a second fastener coupled to said helmet, said second fastener being complementary to said first fastener wherein said second fastener is positioned for reversibly coupling to said first fastener for coupling said dummy to said crossbeam wherein said dummy is configured for tackling by a user, said second fastener comprising a ring wherein said ring is positioned for inserting said rod for coupling said dummy to said crossbeam wherein said ring is positioned for sliding off said rod for decoupling said dummy from said crossbeam upon tackling of said dummy by the user;

a first power module coupled to and positioned in said rod;

a sensor coupled to and positioned in said rod, said sensor being operationally coupled to said first power module wherein said sensor is configured for detecting decoupling of said ring from said rod;

a transmitter coupled to and positioned in said rod, said transmitter being operationally coupled to said first power module and said sensor wherein said transmitter is configured for receiving a signal from said sensor upon the user tackling said dummy and for transmitting a respective phrase;

a second power module coupled to said dummy;

a speaker coupled to said head of said dummy, said speaker being operationally coupled to said second power module; and a receiver coupled to said dummy, said receiver being operationally coupled to said second power module wherein said receiver is positioned for receiving the respective phrase from said transmitter and for signaling said speaker for broadcasting the respective phrase to the user.

2. The assembly of claim 1, further including said plurality of nested sections comprising a lower section and an upper section, said upper section being selectively extensible from said lower section.

3. The assembly of claim 2, further including a coupler coupled to said lower section proximate to an upper end of said lower section, said coupler being selectively couplable to said upper section for coupling said upper section to said lower section wherein said upper section is fixedly positioned relative to said lower section.

4. The assembly of claim 1, further including said tubes and said crossbeam being circularly shaped when viewed longitudinally, said tubes and said crossbeam comprising polyvinyl chloride.

5. The assembly of claim 3, further including said coupler comprising a compression fitting.

6. The assembly of claim 1, further including each said base comprising:

a first pipe coupled to and extending bidirectionally from said respective said tube such that said first pipe extends perpendicularly to a plane defined by said tubes and said crossbeam, said respective said tube being positioned proximate to a first end of said first pipe; and a second pipe coupled to and extending angularly between said respective said tube and said first pipe, said second pipe positioned proximate to a second end of said first pipe wherein said second pipe is configured for bracing said respective said tube.

7. The assembly of claim 6, further including said first pipe and said second pipe being circularly shaped when viewed longitudinally, said first pipe and said second pipe comprising polyvinyl chloride.

8. The assembly of claim 6, further including:

a plurality of channels, each said channel being positioned through a respective said first pipe; and a plurality of spikes, each said spike being configured for inserting through a respective said channel into the surface for coupling said respective said first pipe to the surface.

9. The assembly of claim 8, further including said plurality of channels comprising four said channels positioned singly proximate to said first end and said second end of each said first pipe.

10. The assembly of claim 8, further including each said spike comprising a shaft and a plate, said shaft having a first endpoint, said first endpoint being pointed such that said first endpoint is configured for inserting into the surface, said plate being coupled to and extending perpendicularly from a second endpoint of said shaft wherein said plate is configured for abutting said respective said first pipe when said shaft is inserted through said respective said channel into the surface.

11. The assembly of claim 1, further including said dummy being humanoid shaped.

12. The assembly of claim 11, further including said dummy comprising:

a shell defining an interior space, said shell comprising canvas;

a filler positioned in and substantially occupying said interior space, said filler comprising foam;

a uniform positioned on said shell;

a pair of cleats, each said cleat being positioned on a respective foot of said dummy; and protective gear positioned between said uniform and said shell wherein said dummy is configured for resembling a football player.

13. The assembly of claim 1, further including said rod being circularly shaped when viewed longitudinally, said rod comprising polyvinyl chloride.

14. The assembly of claim 1, further including said first power module comprising a first battery, said second power module comprising a second battery.

15. A football tackling practice assembly comprising:

a pair of tubes, each said tube comprising a plurality of nested sections such that said tube is selectively extensible, said plurality of nested sections comprising a lower section and an upper section, said upper section being selectively extensible from said lower section, said tubes being circularly shaped when viewed longitudinally, said tubes comprising polyvinyl chloride;

a coupler coupled to said lower section proximate to an upper end of said lower section, said coupler being selectively couplable to said upper section for coupling said upper section to said lower section wherein said upper section is fixedly positioned relative to said lower section, said coupler comprising a compression fitting;

a crossbeam coupled to a top of each said tube and extending between said tubes, said crossbeam being circularly shaped when viewed longitudinally, said crossbeam being tubular, said crossbeam comprising polyvinyl chloride;

a pair of bases, each said base being coupled to and extending perpendicularly from a bottom of a respective said tube wherein said bases are configured for supporting said tubes perpendicularly to a surface, each said base comprising:

a first pipe coupled to and extending bidirectionally from said respective said tube such that said first pipe extends perpendicularly to a plane defined by said tubes and said crossbeam, said respective said tube being positioned proximate to a first end of said first pipe, and a second pipe coupled to and extending angularly between said respective said tube and said first pipe, said second pipe positioned proximate to a second end of said first pipe wherein said second pipe is configured for bracing said respective said tube, said first pipe and said second pipe being circularly shaped when viewed longitudinally, said first pipe and said second pipe comprising polyvinyl chloride;

a plurality of channels, each said channel being positioned through a respective said first pipe, said plurality of channels comprising four said channels positioned singly proximate to said first end and said second end of each said first pipe;

a plurality of spikes, each said spike being configured for inserting through a respective said channel into the surface for coupling said respective said first pipe to the surface, each said spike comprising a shaft and a plate, said shaft having a first endpoint, said first endpoint being pointed such that said first endpoint is configured for inserting into the surface, said plate being coupled to and extending perpendicularly from a second endpoint of said shaft wherein said plate is configured for abutting said respective said first pipe when said shaft is inserted through said respective said channel into the surface;

a first fastener coupled to said crossbeam, said first fastener comprising a rod coupled to and extending from said crossbeam equally distant from said tubes such that said rod extends perpendicularly to the plane defined by said tubes and said crossbeam, said rod being tubular, said rod being circularly shaped when viewed longitudinally, said rod comprising polyvinyl chloride;

a dummy, said dummy being humanoid shaped, said dummy comprising:

a shell defining an interior space, said shell comprising canvas, a filler positioned in and substantially occupying said interior space, said filler comprising foam, a uniform positioned on said shell, a pair of cleats, each said cleat being positioned on a respective foot of said dummy, protective gear positioned between said uniform and said shell, and a helmet coupled to a head of said dummy wherein said dummy is configured for resembling a football player;

a second fastener coupled to said helmet, said second fastener being complementary to said first fastener wherein said second fastener is positioned for reversibly coupling to said first fastener for coupling said dummy to said crossbeam wherein said dummy is configured for tackling by a user, said second fastener comprising a ring wherein said ring is positioned for inserting said rod for coupling said dummy to said crossbeam wherein said ring is positioned for sliding off said rod for decoupling said dummy from said crossbeam upon tackling of said dummy by the user;

a first power module coupled to and positioned in said rod, said first power module comprising a first battery;

a sensor coupled to and positioned in said rod, said sensor being operationally coupled to said first power module wherein said sensor is configured for detecting decoupling of said ring from said rod;

a transmitter coupled to and positioned in said rod, said transmitter being operationally coupled to said first power module and said sensor wherein said transmitter is configured for receiving a signal from said sensor upon the user tackling said dummy and for transmitting a respective phrase;

a second power module coupled to said dummy, said second power module comprising a second battery;

a speaker coupled to said head of said dummy, said speaker being operationally coupled to said second power module; and a receiver coupled to said dummy, said receiver being operationally coupled to said second power module wherein said receiver is positioned for receiving the respective phrase from said transmitter and for signaling said speaker for broadcasting the respective phrase to the user.

* * * * *